US011142995B2

(12) United States Patent
Warren et al.

(10) Patent No.: US 11,142,995 B2
(45) Date of Patent: Oct. 12, 2021

(54) VALVE WITH INTEGRATED FLUID RESERVOIR

(71) Applicant: Halliburton Energy Services, Inc., Houston, TX (US)

(72) Inventors: Caleb Thomas Warren, Dallas, TX (US); Geir Gjelstad, Dallas, TX (US); Thomas Frosell, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/637,632

(22) PCT Filed: Aug. 22, 2019

(86) PCT No.: PCT/US2019/047645
§ 371 (c)(1),
(2) Date: Feb. 7, 2020

(87) PCT Pub. No.: WO2020/068320
PCT Pub. Date: Apr. 2, 2020

(65) Prior Publication Data

US 2020/0399982 A1 Dec. 24, 2020

Related U.S. Application Data

(60) Provisional application No. 62/735,344, filed on Sep. 24, 2018.

(51) Int. Cl.
*E21B 34/08* (2006.01)
*E21B 43/12* (2006.01)
(Continued)

(52) U.S. Cl.
CPC ..... *E21B 34/08* (2013.01); *E21B 34/14* (2013.01); *E21B 43/12* (2013.01); *E21B 43/128* (2013.01); *E21B 43/32* (2013.01); *E21B 2200/06* (2020.05)

(58) Field of Classification Search
CPC .... E21B 34/08; E21B 43/128; E21B 2200/06; E21B 34/14; E21B 43/32; E21B 43/12; E21B 35/085; E21B 2200/00
See application file for complete search history.

(56) References Cited

U.S. PATENT DOCUMENTS 6,679,324 B2 * 1/2004 Den Boer ..... E21B 34/066 137/827
6,976,542 B2 12/2005 Henriksen et al.
(Continued)

FOREIGN PATENT DOCUMENTS

WO 2008060297 5/2008

OTHER PUBLICATIONS

International Patent Application No. PCT/US2019/047645, International Search Report and Written Opinion, dated Dec. 6, 2019, 11 pages.

*Primary Examiner* — Michael R Wills, III
(74) *Attorney, Agent, or Firm* — Kilpatrick Townsend & Stockton LLP

(57) ABSTRACT

Certain aspects and features of the disclosure relate to a valve device for use in a wellbore. In one example, the valve device includes a body containing swell fluid, a swellable elastomer, and a piston. The swell fluid can contact the swellable elastomer, causing the swellable elastomer to swell. The swellable elastomer can swell and contact the piston. The swellable elastomer can move the piston from a first position to a second position. In the second position, the piston can open, close, or restrict one or more flow paths through the valve device.

18 Claims, 4 Drawing Sheets

(51) Int. Cl.
*E21B 34/14* (2006.01)
*E21B 43/32* (2006.01)

(56) References Cited

U.S. PATENT DOCUMENTS

| | | | | |
|---|---|---|---|---|
| 7,409,999 | B2 | 8/2008 | Henriksen et al. | |
| 7,708,068 | B2 | 5/2010 | Hailey, Jr. | |
| 7,828,067 | B2 | 11/2010 | Scott et al. | |
| 8,453,746 | B2 * | 6/2013 | Hailey, Jr. | E21B 33/00 166/332.8 |
| 9,273,533 | B2 * | 3/2016 | Allison | E21B 33/1208 |
| 2008/0236843 | A1 | 10/2008 | Scott et al. | |
| 2009/0008092 | A1 | 1/2009 | Haeberle et al. | |
| 2010/0243269 | A1 * | 9/2010 | Solhaug | E21B 23/06 166/374 |
| 2011/0147014 | A1 * | 6/2011 | Chen | E21B 33/1208 166/387 |
| 2011/0315405 | A1 | 12/2011 | Solhaug et al. | |
| 2014/0338922 | A1 * | 11/2014 | Lopez | E21B 34/066 166/373 |
| 2015/0198016 | A1 * | 7/2015 | Langlais | E21B 43/04 166/51 |
| 2016/0273308 | A1 * | 9/2016 | Williamson, Jr. | E21B 34/14 |
| 2016/0312579 | A1 | 10/2016 | Green et al. | |
| 2018/0080308 | A1 * | 3/2018 | Dedman | E21B 43/10 |
| 2018/0202259 | A1 | 7/2018 | Tanguy et al. | |

* cited by examiner

VALVE WITH INTEGRATED FLUID RESERVOIR

TECHNICAL FIELD

The present disclosure relates generally to devices for use in wells. More specifically, but not by way of limitation, this disclosure relates to a valve device, including a fluid reservoir, actuated by a swelling elastomer.

BACKGROUND

A valve is used in well systems (e.g., an oil or gas well systems) to open, close or restrict one or more flow paths downhole in the wellbore. A valve can be actuated using fluid pumped down the wellbore to change the position of the valve. Valves are often installed downhole during completion of a well to help manage or equalize flow in order to optimize production. As an example, a valve can be used as an inflow control device (ICD).

DETAILED DESCRIPTION

Figure 1:
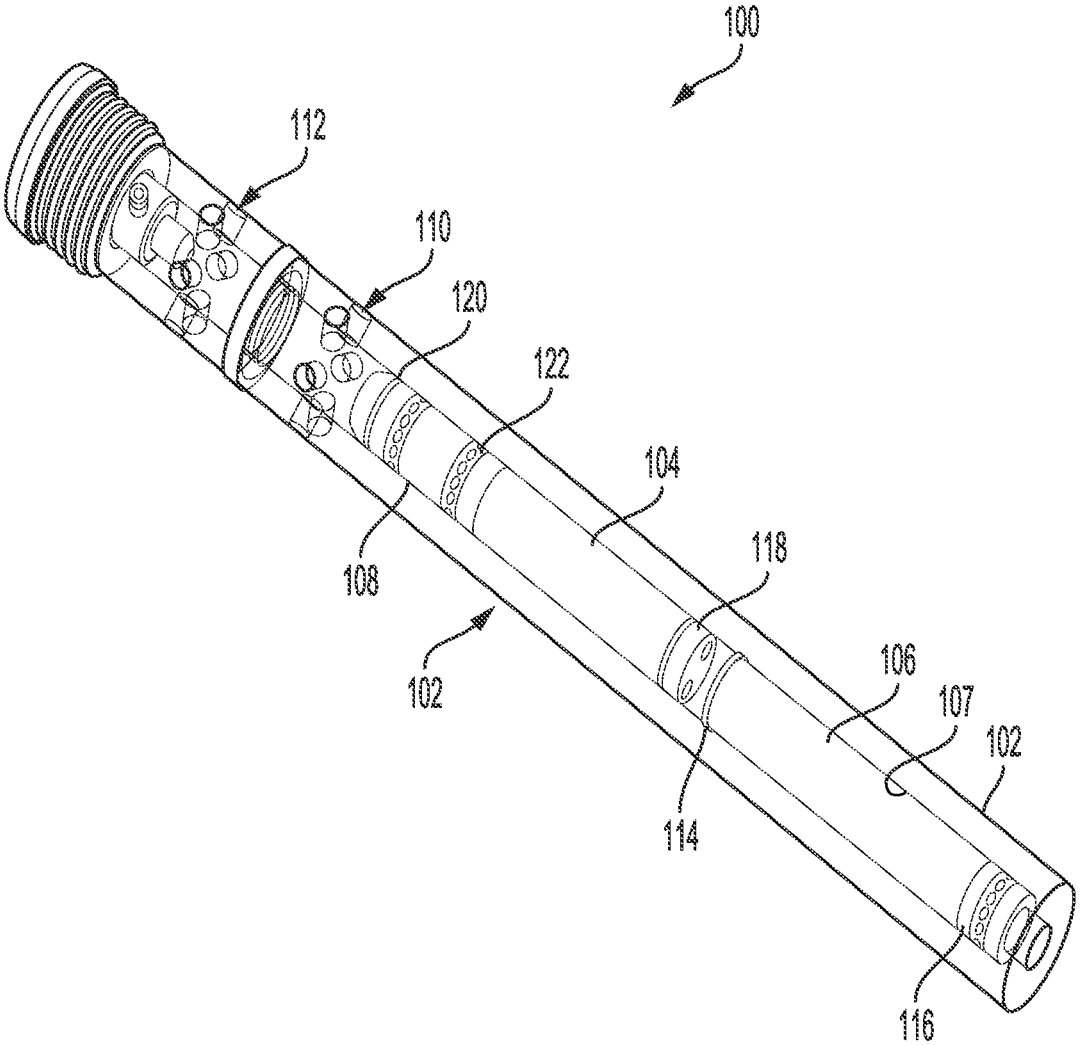
FIG. 1 is a perspective view of a valve device according to some aspects of the present disclosure.

Certain aspects and features of the present disclosure relate to a valve device that uses a piston, moveable by a swellable material, to open, close, or restrict one or more flow paths through the valve device. The swellable material swells in response to contacting swell fluid stored in the valve device prior to the valve device being inserted downhole.

In traditional valve devices, fluid is pumped down the wellbore to actuate the valve device. However, once the valve device has been run downhole, hydraulic lines connected to the valve device can be tangled or fluid pumped down a running string can leak, preventing or impeding actuation of the valve device. Improper or impeded actuation of the valve device can prevent proper completion and operation of the wellbore. The valve device being located downhole prevents easy access to fix these actuation problems.

A valve device can be actuated by an elastomer that swells when immersed in or exposed to a swell fluid (e.g., water or hydrocarbon fluid). The swell fluid is stored in the valve device prior to running the valve device downhole in a wellbore. The swell fluid contained in the valve device can contact the elastomer, causing the elastomer to swell and move a piston within the valve device. The piston can move to seal, open, or restrict one or more flow paths through the valve device. By including the swell fluid in the valve device prior to running the valve device downhole, proper actuation can occur regardless of the fluids present or absent in the wellbore. Additionally, including the swell fluid prior to running the valve device downhole allows the valve device to be deployed in wellbores where a traditional valve would otherwise fail.

In some examples, the components of the valve device can include a volume of swell fluid (e.g., an oil-based fluid) stored in the valve device, swellable elastomer (e.g., rubber), and a piston to isolate the flow ports when the valve has actuated. The valve can also include seals to isolate the swell material and swell fluid from wellbore fluids, a mechanism to limit the direction of the swell of the rubber (e.g., mesh or a plate), and a destructible barrier or other barrier (e.g., rupture plate, low melting alloy/eutectic, paraffin wax, etc.) to prevent the swell fluid from contacting the swell material during storage.

The destructible barrier can be open prior to or during a run-in-hole configuration (e.g., either at a very low pressure to allow it to open during running via hydrostatic pressure, or a value above the bottom-hole pressure to allow the operator to start the swelling process by increasing the well pressure). Other barriers, in place of the destructible barrier, located between the swell fluid and swell rubber can melt away at a temperature above the ambient surface temperature. The barrier can remain in place until it reaches a temperature near the bottom-hole temperature.

In response to the destructible barrier breaking, the swell fluid can contact the swellable elastomer to cause the elastomer to expand and move the piston. The piston can move to open, close, or restrict one or more flow paths through the valve device.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 is a perspective view of a valve device 100 according to some aspects of the present disclosure. The valve device 100 can be used in a wellbore to open, close, or restrict one or more flow paths downhole. For clarity purposes, some portions of the valve device 100 are illustrated as transparent. The valve device 100 can be used as an inflow-control device (ICD) or as a device to establish a less restrictive flow path for use with an ICD, however, it should be appreciated that the valve device 100 can be used for other applications.

The valve device 100 includes a body 102 (e.g., a tubular body) containing swellable elastomer 104. An elastomer is a polymer with elastic properties. A swellable elastomer swells by at least 10% by volume when it contacts a liquid such as water or hydrocarbon fluid. Because of its elastic properties, such an elastomer's swelling can be directed through the use of obstructions that prevent swelling in some directions but permit swelling in other directions. The elastomer 104 can swell in response to swell fluid 106. The swell fluid 106 is contained in the body 102 in a swell fluid chamber 107. In some examples, the swell fluid 106 is added to the body 102 prior to the valve device 100 being sent down the wellbore. The swell fluid 106 is allowed to contact the elastomer 104 which begins to swell as the valve device 100 travels down the wellbore.

The elastomer 104 can swell and contact a piston 108. The elastomer 104 can move the piston 108 from a first position (e.g., an open state) to a second position (e.g., a closed state). In the second position, the piston 108 can open, close, or restrict one or more flow paths through the valve device 100. A flow path allows well fluid to travel from an inlet opening 110 through the body 102 to an outlet opening 112.

In some examples, a floating piston 116 can be positioned within the body 102 adjacent the swell fluid 106. The floating piston 116 can move within the body 102 toward the swell fluid 106. The floating piston 116 can aid in increasing the pressure in the swell fluid 106 or increasing the speed or amount of swell fluid 106 that contacts the swellable elastomer 104. For example, the pressure in the wellbore can be increased, causing the floating piston 116 to move, increasing the pressure of the swell fluid 106.

One or more rupture plates 114 are positioned between the swell fluid 106 and the elastomer 104. The rupture plate 114 can remain intact and prevent the swell fluid 106 from contacting the elastomer 104 until a predetermined condition has been met. Once the predetermined condition has been met, the rupture plate 114 can rupture, allowing the swell fluid 106 to contact the elastomer 104. For example, the rupture plate 114 can rupture once the swell fluid 106 has reached a certain pressure. Additionally or alternatively, the rupture plate 114 can rupture in response to hydrostatic pressure in the wellbore, pressure in the wellbore above bottom-hole pressure, or increased temperature in the wellbore. In some examples, the destructible barrier can be compromised at the surface prior to running the valve device 100 down the wellbore.

A retainer plate 118 (e.g., a mesh disk) is mounted in the body 102 to restrict the swelling of the elastomer 104. For example, the retainer plate 118 can prevent the elastomer 104 from swelling in a direction away from the piston 108 and provides a reaction to axial swell forces. The retainer plate 118 can include holes or mesh that allows the swell fluid 106 to flow through the retainer plate 118 and contact the elastomer 104.

In some examples, the piston 108 includes a snap ring 120 that holds the piston 108 in place and prevents axial movement. The snap ring 120 can be coupled with the piston and used to latch into a groove in the body 102. The snap ring 120 can hold the piston 108 in place before or after movement. For example, the snap ring 120 can hold the piston 108 in place after the piston 108 has moved from the first position to the second position. Additionally or alternatively, the piston 108 includes one or more O-rings 122 that help hold the piston 108 in position. For example, O-rings 122 can prevent the piston 108 from moving before the elastomer 104 has swollen. Other means of holding the piston in position may include bonding the piston to the elastomer or by mechanical fasteners.

Figure 2:
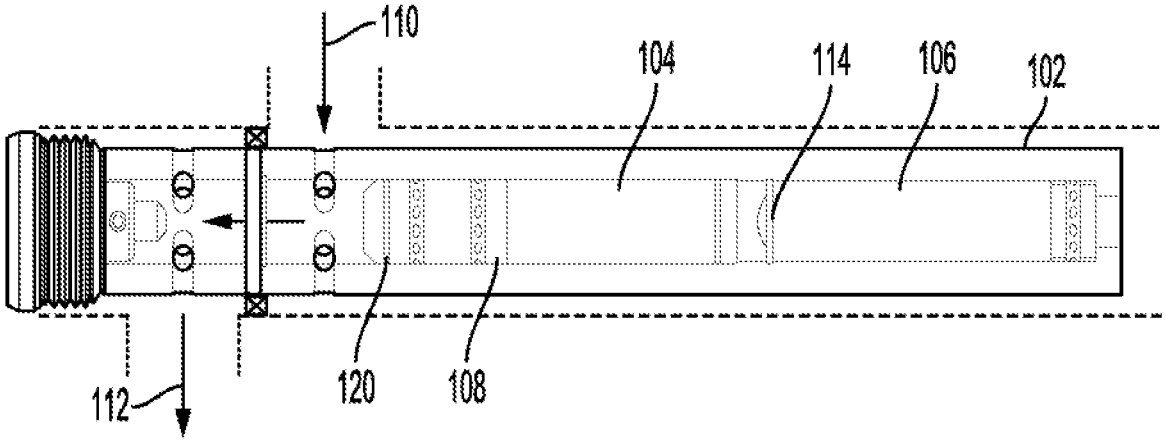
FIG. 2 and FIG. 3 are side views of a portion of a valve device with a piston moving from an open position to a closed position according to some aspects of the present disclosure.
Figure 3:
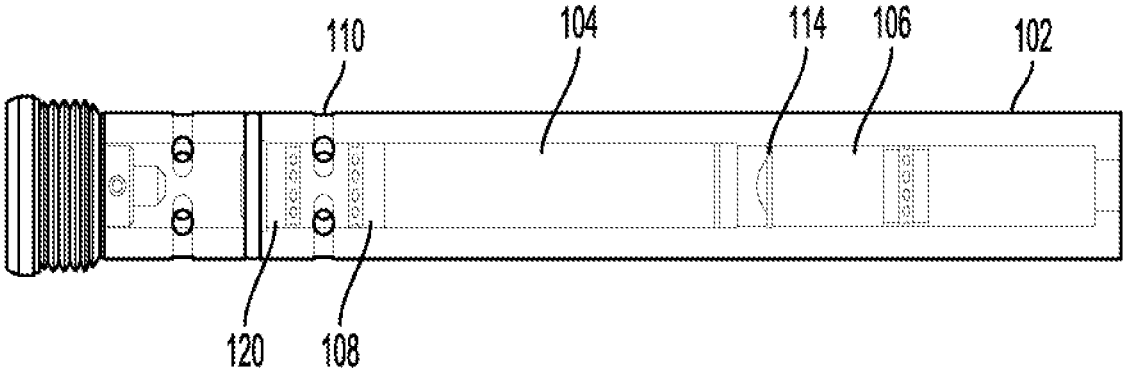

FIGS. 2 and 3 illustrate a valve device 100 with a piston 108 changing a flow path from an open position to a closed position. For clarity, FIGS. 2 and 3 are discussed with reference to valve device 100 and associated components described in FIG. 1, but other implementations and components are possible. Turning to FIG. 2, the flow path is in an open position. The rupture plate 114 is still intact and preventing the swell fluid 106 from contacting the swellable elastomer 104. The elastomer 104 is in an unswollen position and has not moved the piston 108 to change the flow path from the open position. In the open position, the flow path allows well fluid to flow from the inlet opening 110 through the body 102 to the outlet opening 112.

FIG. 3 shows the flow path in a closed position. The rupture plate 114 has ruptured, for example, from increased heat or pressure in the wellbore. Swell fluid 106 has flowed past the ruptured rupture plate 114 and contacted the swellable elastomer 104. The elastomer 104 has swollen and moved the piston 108 to change the flow path from the open position to the closed position. In the closed position, well fluid can no longer flow through the inlet opening 110. A snap ring 120 can prevent the piston 108 from changing the flow path from the closed position.

Figure 4:
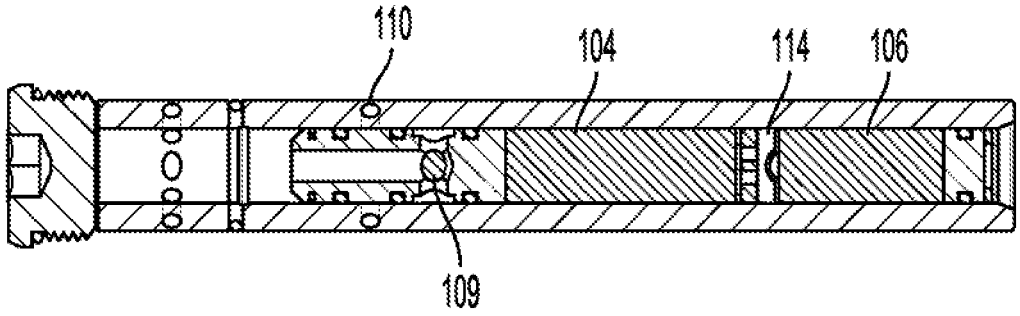
FIG. 4 and FIG. 5 are cross-sectional views of a portion of a valve device with a piston moving from a closed position to an open position according to some aspects of the present disclosure.
Figure 5:
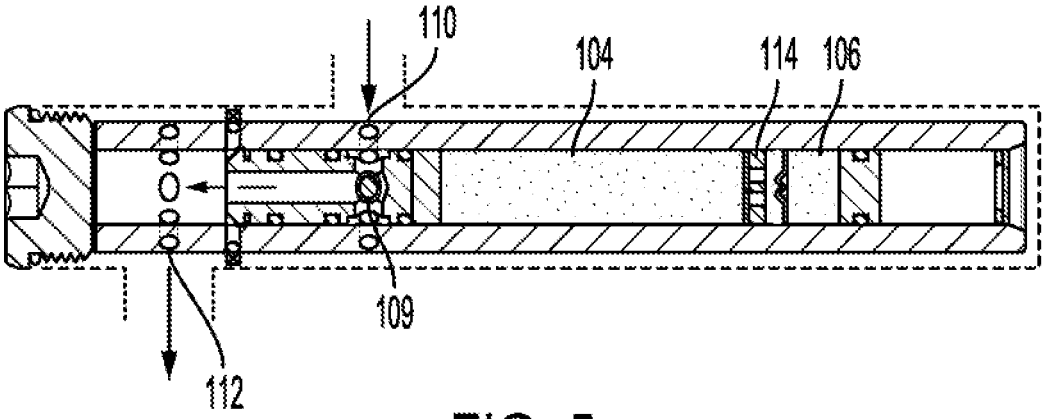

FIGS. 4 and 5 illustrate a valve device 100 with a piston 108 changing the flow path from a closed position to an open position. As with FIGS. 2 and 3, references are made to valve device 100 and associated components described in FIG. 1, but other implementations and components are possible. In FIG. 4, the rupture plate 114 is still intact, the swell fluid 106 has not contacted the elastomer 104, and the elastomer 104 is unswollen. The flow path is in the closed position and prevents well fluid from entering the inlet opening 110.

In FIG. 5, the rupture plate 114 has ruptured, allowing the swell fluid 106 to contact the elastomer 104. The elastomer 104 has swollen and moved the piston 108 to change to flow path to the open position. The piston 108 can include an opening 109 allowing fluid to flow through the piston 108 when the flow path is in the open position. In the open position, well fluid can flow from the inlet opening 110, through the piston opening 109, to the outlet opening 112. A snap ring 120 can hold the piston 108 preventing the piston 108 from changing the flow path from the open position, allowing well fluid to flow through the valve device 100.

Figure 6:
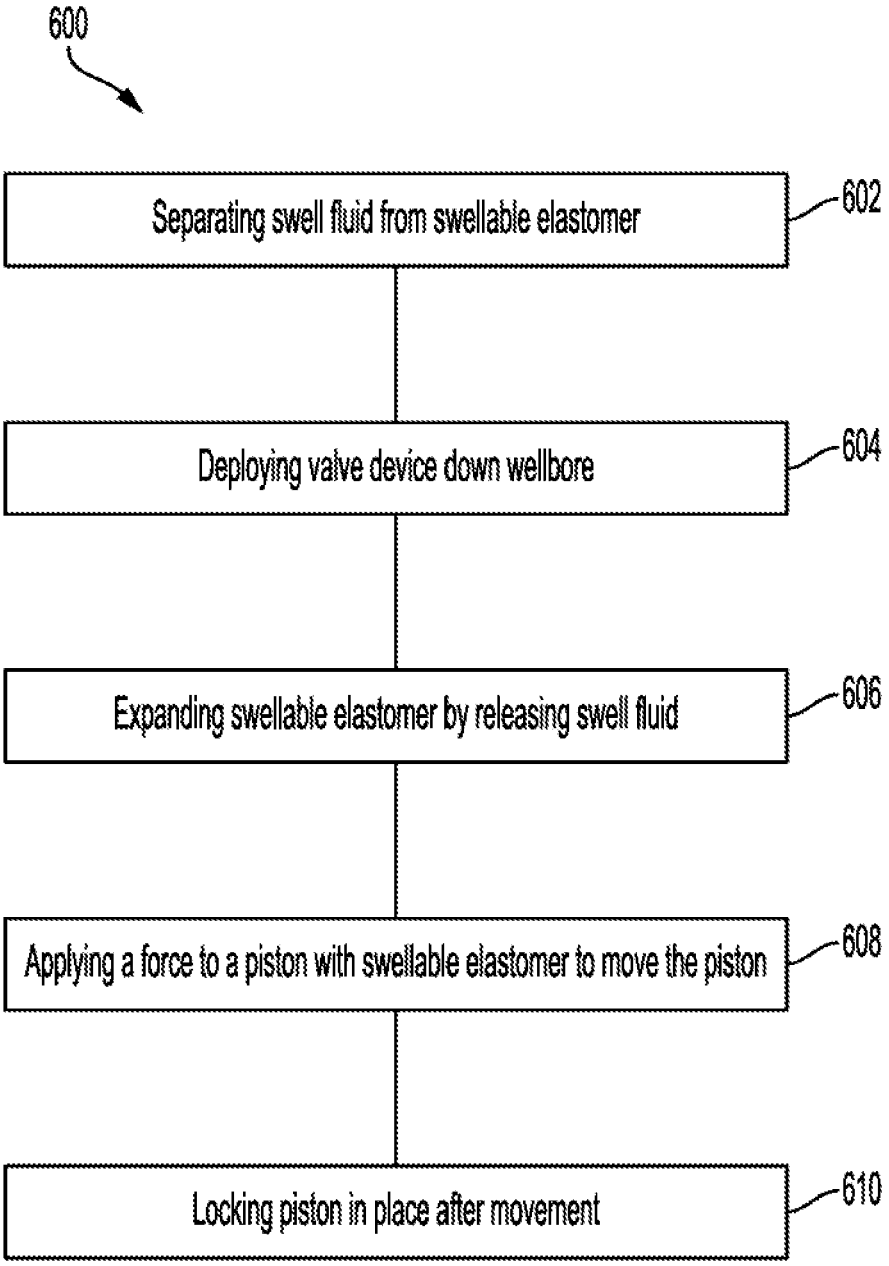
FIG. 6 is a flowchart of a process for using a valve device according to some aspects of the present disclosure.

Some examples of the present disclosure can overcome one or more of the above mentioned issues by implementing the process shown in FIG. 6. Some examples can include more, fewer, or different steps than the steps depicted in FIG. 6. Also, some examples can implement the steps of the process in a different order. For clarity, the steps of FIG. 6 described below are discussed with reference to the components of FIG. 1, but other implementations are possible.

At block 602, swell fluid 106 can be separated from an elastomer 104. The swell fluid 106 and elastomer 104 can be contained in the body 102 of a valve device 100. The swell fluid 106 and elastomer 104 can be separated by one or more rupture plates 114. When intact, the rupture plate 114 can prevent the swell fluid 106 from contacting the elastomer 104. After rupturing, the rupture plate 114 can allow the swell fluid 106 to contact the elastomer 104.

At block 604, the valve device 100 can be deployed in a wellbore. The valve device 100 can include the swell fluid 106 in the body 102. The body 102 can protect the other components of the valve device 100 in the wellbore. The valve device 100 can travel downhole in the wellbore until it reaches some predetermined depth. The depth can be determined by the pressure or heat in the wellbore. Once the predetermined depth is reached, the rupture plate 114 can rupture allowing the swell fluid 106 to contact the elastomer 104.

At block 606, the elastomer 104 can expand after contacting the swell fluid 106. The swell fluid 106 can contact the elastomer 104 after the rupture plate 114 has ruptured. Additionally or alternatively, the swell fluid 106 can contact the elastomer 104 after being manually released by a user. After the swell fluid 106 contacts the elastomer 104. The elastomer 104 can expand in one or more directions within the body 102. The body 102 and a retainer plate 118 can reduce or prevent the elastomer 104 from expanding in a direction away from a piston 108.

In some examples, no rupture plate 114 is used and the swell fluid 106 can be loaded in the body 102 and contact the elastomer 104 prior to the valve device 100 being deployed in a wellbore. The elastomer 104 can swell while the valve device 100 travels downhole in the wellbore until it reaches the predetermined depth. The elastomer 104 can be in the fully swollen state once it reaches the predetermined depth or can continue to swell.

At block 608, the elastomer 104 can expand and apply a force to the piston 108, causing the piston 108 to move. After moving, the piston 108 can open, close, or restrict one or more flow paths through the valve device 100. For example, the piston 108 can move from a first position to a second position. In the first position, the piston 108 can open the flow path and allow well fluid to flow through an inlet opening 110 through the body 102 to an outlet opening 112. In the second position, the piston 108 can close the flow path and block the inlet opening 110 and prevent the well fluid from entering the body 102. However, the piston 108 can include a piston opening 109, such that, in the first position, the piston 108 can close the flow path and block well fluid from flowing into the inlet opening 110 and in the second position, the piston 108 can open the flow path and well fluid can flow in the inlet opening 110, through the piston opening 109, to the outlet opening 112.

At block 610, the piston 108 can be locked in place after it has moved from the first position to the second position. The piston 108 can be locked in place using a snap ring 120, an O-ring 122, or a combination of a snap ring 120 and an O-ring 122. The snap ring 120 can lock into a groove in the body 102 to prevent the piston 108 from moving in an axial direction. The piston 108 can be locked in place to prevent well fluid from entering the inlet opening 110 or allow well fluid to enter the inlet opening 110.

As used below, any reference to a series of examples is to be understood as a reference to each of those examples disjunctively (e.g., "Examples 1-4" is to be understood as "Examples 1, 2, 3, or 4").

Example 1 is a valve for use in a wellbore, the valve including: a body defining a chamber for receiving and storing swell fluid prior to inserting the valve into the wellbore; a swellable elastomer disposed in the body adjacent the chamber so as to swell in response to contact with the swell fluid from the chamber; and a piston disposed in the body, the piston movable from a first position to a second position in response to the swellable elastomer swelling to change a flow path between an open state and a closed state.

Example 2 is the valve of example(s) 1, further including a destructible barrier disposed in the body between the chamber and the swellable elastomer, the barrier separating the swell fluid from the swellable elastomer when intact and allowing the swell fluid to contact the swellable elastomer when not intact.

Example 3 is the valve of example(s) 2, wherein the barrier is breakable in response to hydrostatic pressure in the chamber or applied pressure.

Example 4 is the valve of example(s) 2, further including a mesh disk disposed in the body between the barrier and the swellable elastomer, the mesh disk preventing the swellable elastomer from expanding in a direction opposite the piston and defining openings allowing the swell fluid to flow between the chamber and the swellable elastomer.

Example 5 is the valve of example(s) 4, wherein the piston is a first piston and the valve further includes a second piston disposed in the body adjacent the chamber, the second piston moveable to aid in the swell fluid contacting the swellable elastomer.

Example 6 is the valve of example(s) 1, wherein the open state of the flow path allows fluid to flow through openings defined by sidewalls of the body and the closed state of the flow path prevents fluid from flowing through the openings.

Example 7 is the valve of example(s) 1, wherein the piston includes a lock ring, the lock ring engagable with sidewalls of the body when the piston moves from the first position to the second position.

Example 8 is a method of manipulating a valve in a wellbore, the method including: storing swell fluid within a valve body prior to inserting the valve into the wellbore; expanding a swellable elastomer disposed in the valve body towards a piston moveable from a first position to a second position within the valve body; and applying a force to the piston, the force applied by the swellable elastomer contacting the piston after swelling in response to the swell fluid to change a flow path between an open state and a closed state.

Example 9 is the method of example(s) 8, further including separating the swell fluid from the swellable elastomer with a destructible barrier prior to swelling the swellable elastomer.

Example 10 is the method of example(s) 9, further including destroying the destructible barrier to allow the swell fluid to contact the swellable elastomer, the destructible barrier destroyed by increasing hydrostatic pressure in the body.

Example 11 is the method of example(s) 10 wherein the piston is a first piston and further including moving a second piston positioned adjacent to the swell fluid to aid the swell fluid in contacting the swellable elastomer.

Example 12 is the method of example(s) 8, further including moving the piston from a first position to a second position, the piston moving in response to the force applied by the swellable elastomer.

Example 13 is the method of example(s) 12, wherein the open state of the flow path allows fluid to flow through openings in the body and the closed state of the flow path prevents fluid from flowing through the openings.

Example 14 is the method of example(s) 12, further including locking the piston in place after the piston has moved from the first position to the second position.

Example 15 is a valve assembly including: a chamber for receiving and storing swell fluid prior to inserting the valve assembly into a wellbore; a swellable elastomer; and a piston that is movable in response to the swellable elastomer swelling subsequent to contacting the swell fluid to change a flow path between any of an open state, a closed state, or a restricted state.

Example 16 is the valve assembly of example(s) 15, further including a destructible barrier between the chamber and the swellable elastomer, the destructible barrier fluidly separating the swell fluid from the swellable elastomer when intact and allowing the swell fluid to contact the swellable elastomer when not intact.

Example 17 is the valve assembly of example(s) 16, wherein the barrier is breakable in response to hydrostatic pressure in the chamber or applied pressure.

Example 18 is the valve assembly of example(s) 16, further including a mesh disk between the barrier and the swellable elastomer, the mesh disk preventing the swellable elastomer from expanding in a direction opposite the piston and defining openings allowing the swell fluid to flow between the chamber and the swellable elastomer.

Example 19 is the valve assembly of example(s) 18, wherein the piston is a first piston and the valve further including a second piston adjacent the chamber, the piston moveable to aid in the swell fluid contacting the swellable elastomer.

Example 20 is the valve assembly of example(s) 15, wherein the piston includes a lock ring, the lock ring preventing the piston from moving between the open state, the closed state, or the restricted state.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A valve for use in a wellbore, the valve comprising:

a body defining a chamber for receiving and storing swell fluid prior to inserting the valve into the wellbore;

a swellable elastomer disposed in the body adjacent the chamber so as to swell in response to contact with the swell fluid from the chamber;

a first piston disposed in the body, the piston movable from a first position to a second position in response to the swellable elastomer swelling to change a flow path between an open state and a closed state; and a second piston disposed in the body adjacent the chamber, the second piston moveable, in response to an increase of pressure in the wellbore, from a first position to a second position to aid in the swell fluid contacting the swellable elastomer.

2. The valve of claim 1, further comprising a destructible barrier disposed in the body between the chamber and the swellable elastomer, the barrier separating the swell fluid from the swellable elastomer when intact and allowing the swell fluid to contact the swellable elastomer when not intact.

3. The valve of claim 2, wherein the barrier is breakable in response to hydrostatic pressure in the chamber or applied pressure.

4. The valve of claim 2, further comprising a mesh disk disposed in the body between the barrier and the swellable elastomer, the mesh disk preventing the swellable elastomer from expanding in a direction opposite the first piston and defining openings allowing the swell fluid to flow between the chamber and the swellable elastomer.

5. The valve of claim 1, wherein the open state of the flow path allows fluid to flow through openings defined by sidewalls of the body and the closed state of the flow path prevents fluid from flowing through the openings.

6. The valve of claim 1, wherein the first piston comprises a lock ring, the lock ring engagable with sidewalls of the body when the piston moves from the first position to the second position.

7. A method of manipulating a valve in a wellbore, the method comprising:

storing swell fluid within a valve body prior to inserting the valve into the wellbore;

moving, in response to an increase of pressure in the wellbore, a first piston disposed in the valve body from a first position to a second position to aid in the swell fluid contacting a swellable elastomer disposed in the valve body;

expanding the swellable elastomer body towards a second piston moveable from a first position to a second position within the valve body; and applying a force to the second piston, the force applied by the swellable elastomer contacting the second piston after swelling in response to the swell fluid to change a flow path between an open state and a closed state.

8. The method of claim 7, further comprising separating the swell fluid from the swellable elastomer with a destructible barrier prior to swelling the swellable elastomer.

9. The method of claim 8, further comprising destroying the destructible barrier to allow the swell fluid to contact the swellable elastomer, the destructible barrier destroyed by increasing hydrostatic pressure in the body.

10. The method of claim 7, further comprising moving the second piston from a first position to a second position, the second piston moving in response to the force applied by the swellable elastomer.

11. The method of claim 10, wherein the open state of the flow path allows fluid to flow through openings in the body and the closed state of the flow path prevents fluid from flowing through the openings.

12. The method of claim 10, further comprising locking the second piston in place after the second piston has moved from the first position to the second position.

13. A valve assembly comprising:

a chamber for receiving and storing swell fluid prior to inserting the valve assembly into a wellbore;

a swellable elastomer;

a first piston that is movable in response to the swellable elastomer swelling subsequent to contacting the swell fluid to change a flow path between any of an open state, a closed state, or a restricted state; and a second piston adjacent the chamber, the second piston moveable in response to an increase of pressure in the wellbore to aid in the swell fluid contacting the swellable elastomer.

14. The valve assembly of claim 13, further comprising a destructible barrier between the chamber and the swellable elastomer, the destructible barrier fluidly separating the swell fluid from the swellable elastomer when intact and allowing the swell fluid to contact the swellable elastomer when not intact.

15. The valve assembly of claim 14, wherein the barrier is breakable in response to hydrostatic pressure in the chamber or applied pressure.

16. The valve assembly of claim 14, further comprising a mesh disk between the barrier and the swellable elastomer, the mesh disk preventing the swellable elastomer from expanding in a direction opposite the first piston and defining openings allowing the swell fluid to flow between the chamber and the swellable elastomer.

17. The valve assembly of claim 16, wherein the piston is a first piston and the valve further comprising a second piston adjacent the chamber, the piston moveable to aid in the swell fluid contacting the swellable elastomer.

18. The valve assembly of claim 13, wherein the first piston comprises a lock ring, the lock ring preventing the first piston from moving between the open state, the closed state, or the restricted state.

* * * * *